US007086206B2

(12) United States Patent
Wang et al.

(10) Patent No.: US 7,086,206 B2
(45) Date of Patent: Aug. 8, 2006

(54) WINDOW LIGHTS AND FRAMES FOR FOAM CORE DOORS

(75) Inventors: Shirley Wang, Cedar Grove, NJ (US); Pao Yu An, Morris Plains, NJ (US); Wen Hsian Chen, Yung Kang (TW)

(73) Assignee: Plastpro 2000, Inc., Livingston, NJ (US)

( * ) Notice: Subject to any disclaimer, the term of this patent is extended or adjusted under 35 U.S.C. 154(b) by 19 days.

(21) Appl. No.: 10/759,920

(22) Filed: Jan. 16, 2004

(65) Prior Publication Data

US 2004/0144046 A1 Jul. 29, 2004

Related U.S. Application Data

(63) Continuation of application No. 09/953,055, filed on Sep. 14, 2001, now Pat. No. 6,694,701.

(51) Int. Cl.
*E04B 2/00* (2006.01)

(52) U.S. Cl. ..... 52/506.01; 52/205; 52/204.7; 52/211

(58) Field of Classification Search ..... 52/506.01, 52/205, 204.593, 204.7, 211, 212
See application file for complete search history.

(56) References Cited

U.S. PATENT DOCUMENTS

| | | | | | |
|---|---|---|---|---|---|
| 3,340,663 | A * | 9/1967 | Collard | 52/775 |
| 3,380,210 | A * | 4/1968 | Neal et al. | 52/235 |
| 4,021,967 | A * | 5/1977 | Mulder et al. | 49/171 |
| 4,184,297 | A * | 1/1980 | Casamayor | 52/202 |
| 5,571,276 | A * | 11/1996 | Kobos et al. | 312/265.6 |
| 5,678,383 | A * | 10/1997 | Danielewicz | 52/775 |
| 6,272,801 | B1 * | 8/2001 | Suh | 52/211 |
| 6,378,931 | B1 * | 4/2002 | Kolluri et al. | 296/146.15 |

* cited by examiner

*Primary Examiner*—Carl D. Friedman
*Assistant Examiner*—Basil Katcheves
(74) *Attorney, Agent, or Firm*—Kenyon & Kenyon

(57) ABSTRACT

In a door constructed of spaced apart skins mounted on a rectangular frame and reinforced with the core between the skins filled with a plastic foam, a window or door light frame system consists of a two part frame system with a window light permanently installed in one part of the system and the other part releasably adapted to register with the frame part with the window light installed during shipping and rotated when installed to bring the locking elements of the several parts into registry to permanently lock the frame system in an aperture formed in a door with stop means in the locking arrangements to prevent damage to the frame system or the door on which the frame system is installed from excessive compressive forces on the frame parts.

36 Claims, 7 Drawing Sheets

WINDOW LIGHTS AND FRAMES FOR FOAM CORE DOORS

CROSS-REFERENCE TO RELATED APPLICATIONS

This application is a continuation of U.S. patent application Ser. No. 09/953,055 filed on Sep. 14, 2001, now U.S. Pat. No. 6,694,701, which is expressly incorporated herein in its entirety by reference thereto.

BACKGROUND

Synthetic doors have become a common place as a replacement for the traditional wooden doors in residences and other building applications. Often such synthetic doors are formed of fiber glass sheets (skins) attached to opposite sides of a rectangular frame forming the stiles and rails of the door with resulting cavity between the sheets filled with a foam. Doors so constructed do not warp, are not subject to insect infestation and are resistant to the elements. Moreover such doors can include graining on the outer surfaces of the skins which gives them the appearance of a natural wood fabricated product.

Traditionally the molded skins for making doors of the type disclosed in U.S. Pat. No. 3,950,894 issued to DiMaio and in U.S. Pat. No. 4,550,540 issued to Thorn are constructed using mixtures having by weight 12% to 15% polyester resin, 5% to 15% polystyrene, 40% to 50% calcium carbonate and 15% to 25% chopped fiberglass. Such mixtures are placed in a layer in a compression molding machine and subjected to pressures from 600 to 1,500 psi for a cure cycle from 60 to 200 seconds. Such mixtures are usually referred to 'sheet molding compounds' [SMCs] and are normally constructed of thermoset materials such as phenolics, urea, melamines and polyesters. A general description of the sheet molding process is found in an article entitled, "Compression Molding" by N. D. Simons in *Modern Plastics Encyclopedia*, Vol. 54 No. 10A (1977–78).

Skins formed from such processes for doors have a thicknesses of from about 0.05 inches to about 0.20 inches, depending on the door application in which they are used.

Other door constructions employ metal skins mounted on a rectangular frame in place of the sheet molded skins described above. Such structures also have a core which is filled with a plastic foam but a different method is often employed to attach the metal skins to the rectangular frame which is typically constructed of wooden stiles and rails, but also may be constructed of plastic materials.

As previously noted such skins are affixed to opposite sides of a rectangular frame and core enclosed by the frame and skins are filled with a foam to complete the door such as illustrated in FIGS. 1 and 2 accompanying this application. The core is typically composed of a rigid urethane foam having a density of 0.8 pounds per cubic foot to 3.5 pounds per cubic foot. The cross section of such prior art doors is illustrated in FIG. 2 where it can be seen that the central portion of such doors contain little structure for attaching window lights and the like, such as are shown installed on the door in FIG. 3. Moreover once the cut outs are made for the window lights in such a door, care must be exercised not to collapse the rigid urethane foam since the foam is not resilient whether the skins are of metal or sheet molded compositions.

In the past frames have been used which employ screws to attached frame members on opposite sides of a door. Since the frames are typically made of plastics, this requires that plugs be inserted in the recessed screw holes. Such plugs often distract from the appearance of the exposed surfaces of the frame because the plugs are made in a different injection molding machine being slightly off color and disfiguration from gluing them in the holes.

It is an object of this invention to provide a frame system which will ensure that a window light held by the frame system will be properly installed in an opening formed in the door in a tight, weather resistant unit without numerous fasteners defacing the outer surfaces of the frame system which is a problem with prior art frame systems.

It is also an object of the current invention to provide a frame system that functions as a shipping container for its associated window light by including dowels and guide pins on the several frame members which allow the frame system to be assembled in a non-locking relationship during shipping and converted to a locking engagement relationship when installed.

Another object of the invention is to provide a frame system which can be field installed which enables contractors to select different window lights for synthetic doors available in the market place.

It is also an object to provide an efficient and quick process for installing window lights in doors in the field which requires minimum effort.

Other objects will be apparent when viewing the descriptions of the invention which follows.

SUMMARY OF THE INVENTION

A self locking frame system for installing a glass pane in an aperture cut in composite doors includes a first frame member having an interior retaining rim for supporting a glass pane and a continuous flange extending perpendicularly from said rim adapted to engage the planner surface of a door on which said first frame member is installed with a glass pane sealing installed in the interior retaining rim of the first frame member along with a second frame member having an interior retaining rim for co-supporting the glass pane installed in the first frame member and a continuous flange extending perpendicularly from said rim adapted to engage the planner surface of a door on the opposite side of the door on which the first frame member is installed and locking means consisting of a plurality of male gripping means interspersed with a plurality of female interlock means on the first frame member positioned along its rim and plurality of male gripping means interspersed with a plurality of female interlock means on the second frame member positioned along its rim so said male gripping means will be in registry with the female interlock means when the frame members are assembled on a door and operable to lock said first frame member to the second frame member when the plurality of male gripping means are received in the plurality of female interlocking means and temporary support means between the first frame member and the second frame member operable to allow both of said frame members to support said glass pane by keeping said frame members in registry and operable to keep the plurality of male gripping means and the plurality of female interlock means out of registry during handling prior to installation on a door.

DESCRIPTION OF THE DRAWINGS

The invention will be better understood by referring to the attached drawing, in conjunction with this specification wherein.

DESCRIPTION OF A PREFERRED EMBODIMENT

Figure 1:
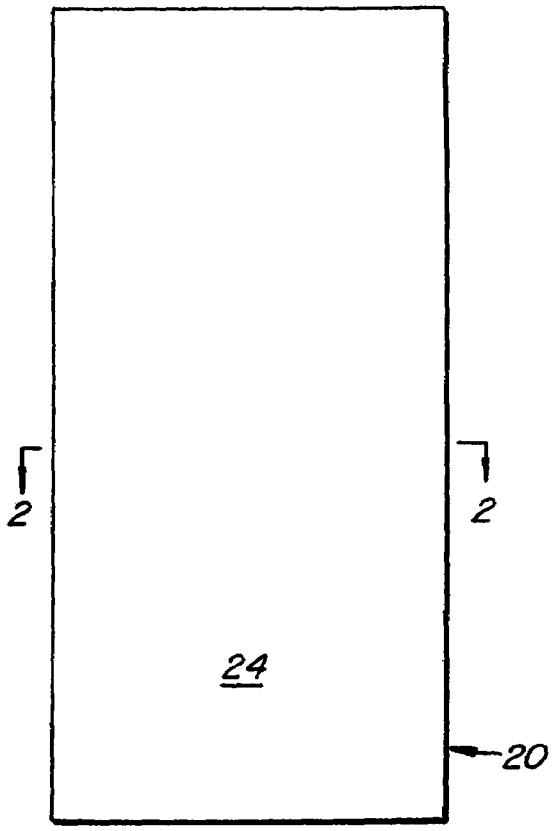
FIG. 1 plan of a typical synthetic door constructed with compression molded skins.

A plain synthetic door 20 of the type described in the above patents is illustrated in FIG. 1. In cross section shown in FIG. 2 the interior components of the door are viewable, which include stiles 21 and 22 which form part of the rectangular frame on which the inner skin 23 is mounted on one side of the frame and the outer skin 24 is mounted on the other side. The skins are usually glued to the rectangular frame which results in a void or cavity between the interior surfaces of the stiles and skins. This void or cavity is filled with a foam 25 to complete the construction of such doors.

Figure 3:
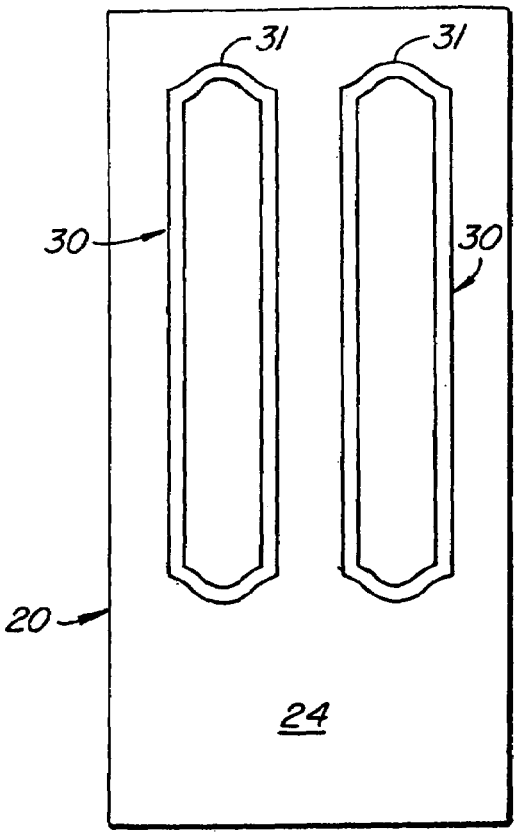
FIG. 3 is a plan of the synthetic door illustrated in FIG. 1 which has the novel frame system installed with window lights.
Figure 2:
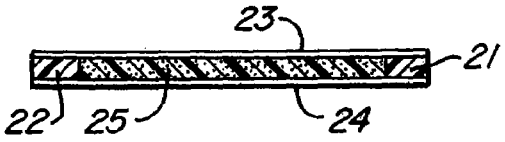
FIG. 2 is a cross-section along line 2—2 of FIG. 1 showing the interior components of the door shown in FIG. 1 and its foam core.

As can be seen in the cross section in FIG. 2 there is little structure in the central portion of the door, other than the two thin skins 23 and 24 and the plastic foam 25, to attach frames for a window light or the like. Moreover, since the window lights may have different perimeter configurations, it is not possible to incorporate physical structure in the central portion of the door during manufacture to provide components for attaching frames, window lights, etc., such as those shown installed in the door in FIG. 3.

Figure 4:
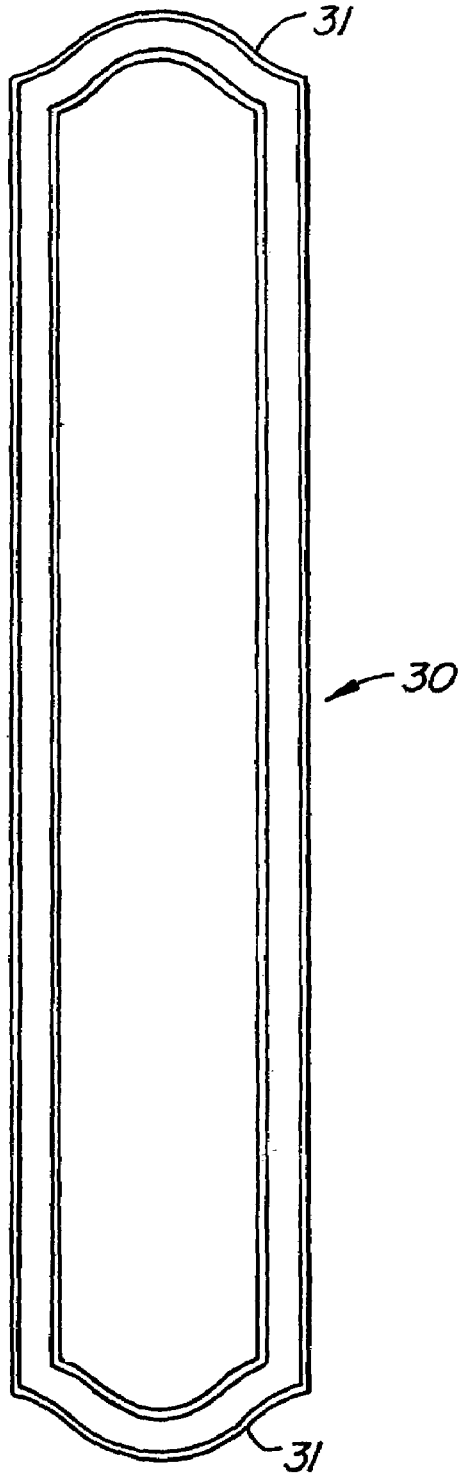
FIG. 4 is plan of one of the popular perimeter configuration of the frame system of the instant invention which will be referenced in describing the invention.

More specifically the perimeter of the frame systems according the this invention can vary, from the elongated frame system 30 illustrated in FIG. 4 with curved ends 31 to a round frame systems (not illustrated). For convenience, the elongated frame system configuration is shown in the drawings and serves to illustrate the features of the invention which are applicable to other frame peripheral configurations.

Figure 5:
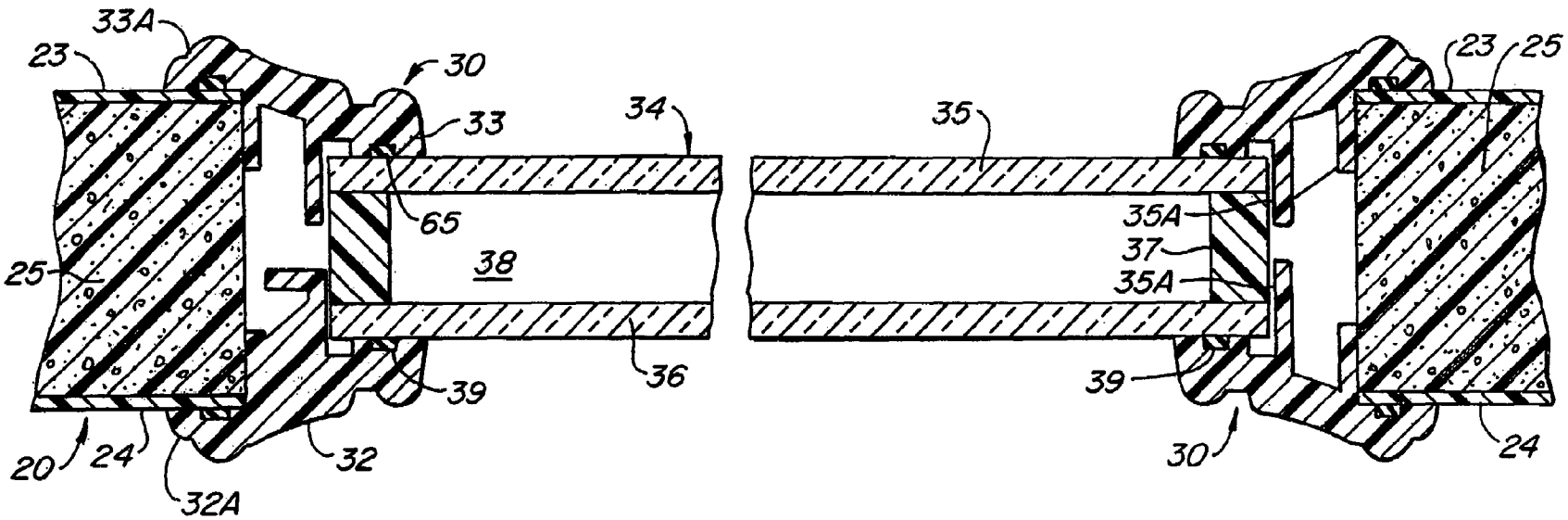
FIG. 5 is a cross section through the frame and window light system of the invention installed in a synthetic door, as shown in FIG. 1, with parts of the door broken away.

Referring to FIG. 5, it can be seen that the frame system 30 consists of two parts, a outer frame member 32 and inner frame member 33. As illustrated, the frame members fit in to an aperture cut in a typical door, such as door 20 and secure the window light between them. Typically the window light 34 is formed to fit exactly into the interior channel 35 of the joined frame members and consists of two panes of glass 35 and 36 which are separated by a perimeter seal 37 so that a chamber is formed between the two panes and the seal. This chamber is typically evacuated and filled with a noble gas 38 or extremely dry air to improve the insulating characteristics of the window light and to eliminate any condensation between the glass panes used in constructing the light. Traditionally such window or door lights are ordered from manufacturers specializing in these items and are delivered in the perimeter configuration ordered and come in the specified thickness ordered.

Figure 6:
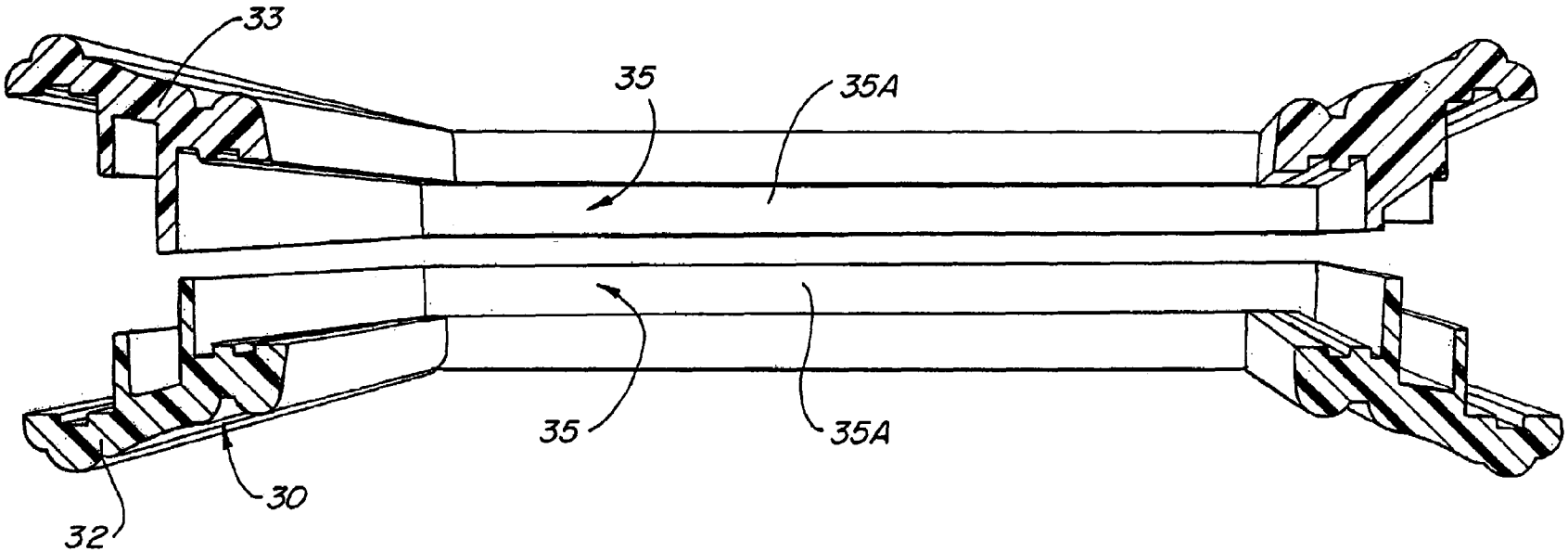
FIG. 6 is a cross section in partial perspective illustrating the two components parts of the frame system joined to form a channel for receiving a window or door light without the interlocking parts shown.

In FIG. 6 the interior channel 35 of the frame system 30 can be readily seen and, as can be seen each component of the frame system, the inner frame member 33 and the outer frame member 32, each have a significant portion 35A of the interior channel 35 formed in that member. As a result the window or door light 34 can be held securely in either frame member.

As a result in practice the window or door light 34 is factory installed in the outer frame member 32 with appropriate caulking in groove 39 to permanently seal the light into this outer frame member whereby there will be no leaks between the frame member and the light when it is installed in a door.

Figure 7:
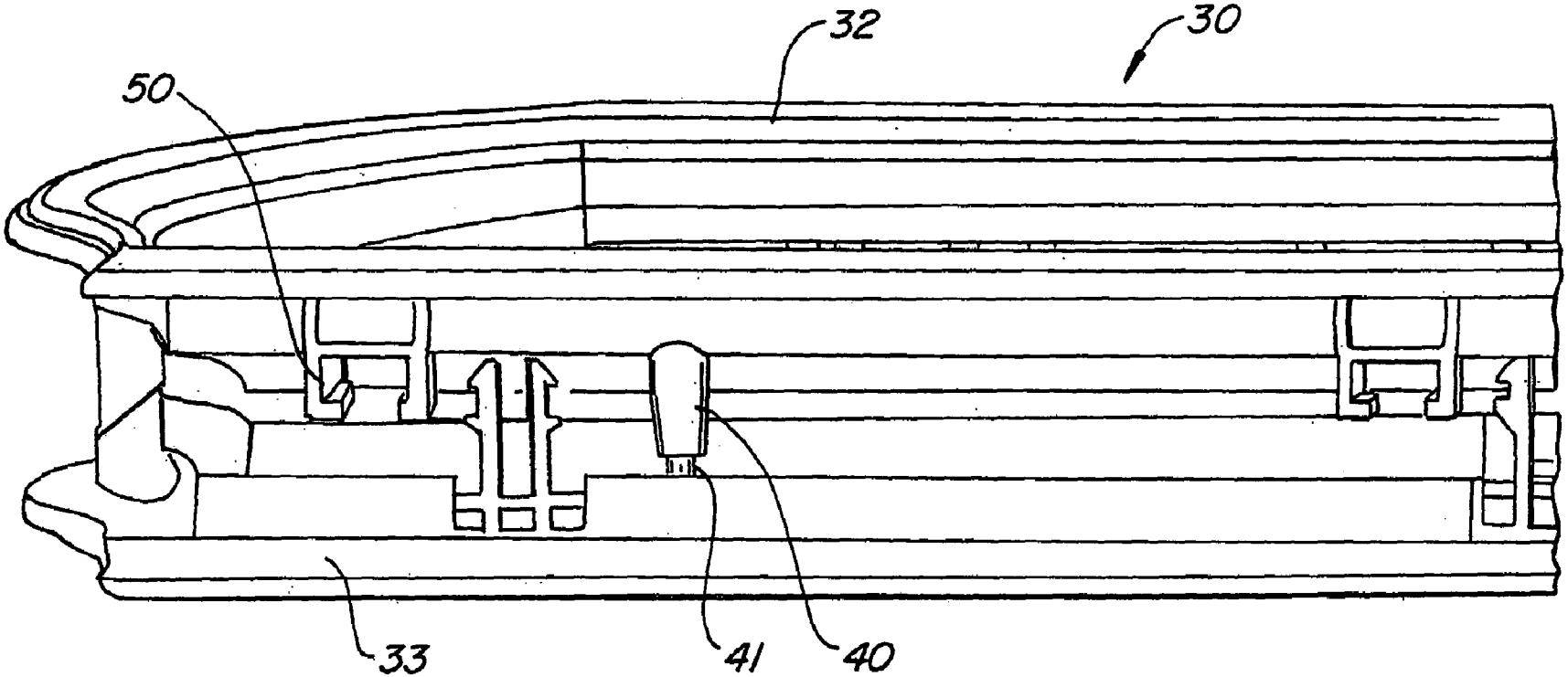
FIG. 7 is a perspective of one end of the frame system with the inner and outer frame members engaged with one another as would be done when the system is shipped with a window light assembled in the frame system.

With the window light 34 permanently installed in the outer frame member 32, the inner frame member 33 is assembled one hundred eighty degrees out of phase with its installed position so that the holes in dowels 40 projecting perpendicularly from the inner frame will mate with the pins 41 projecting perpendicularly from the outer frame member as shown in detail in FIG. 7 in a telescoping manner. The dowels and pins are arranged so that the inner frame member will be in registry with the outer frame member when the pins are received in the holes in the dowels. Thus once the window light is installed in the outer frame member, the inner frame member can be assembled with it on the dowels and pins to retain the light in the frame system for shipping by simply wrapping shipping tape around the entire assembly. This arrangement ensures that edges of the window or door light will be protected during shipping and will prevent damages to the seals 37 employed between the two panes 36 and 36 forming the light. In addition since the inner frame member is connected to the outer frame member through only the dowels and pins, it can be easily removed from the outer frame member for field installation of the light in a door. In one embodiment the dowel and pins are glued together for shipping an the installer merely clips off the pins to separate the frame members when installation commences.

Figure 8:
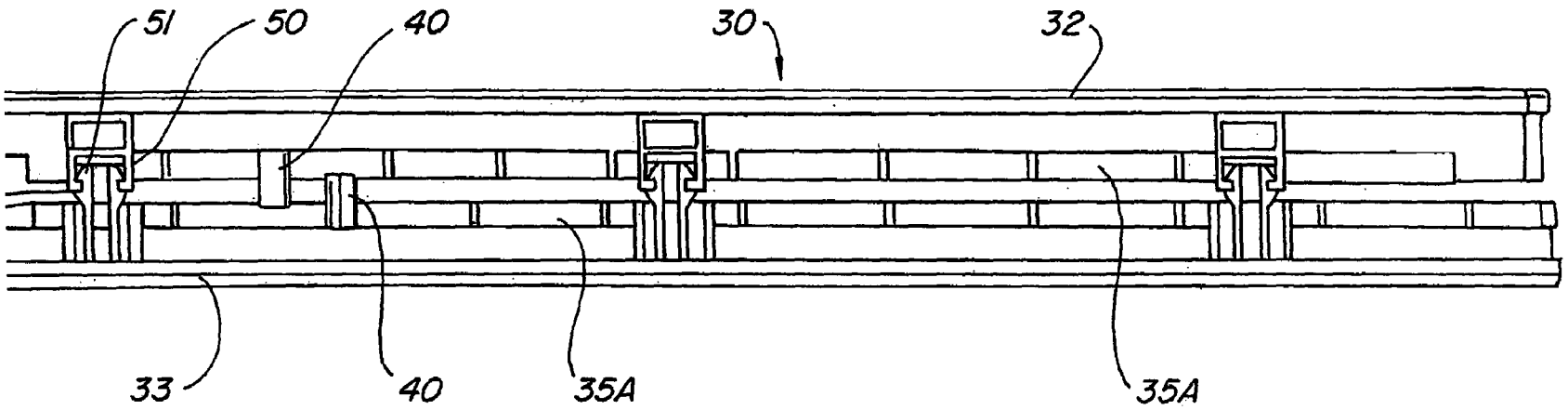
FIG. 8 is a perspective of one end of the frame system with the inner frame turned one hundred and eighty degrees from its position shown in FIG. 7 with its locking system elements fully engaged.

As can also be seen in FIGS. 7 and 10 the double cleat 50 of the outer frame member 32 is off set from the double locking pins 51 on the inner frame member 33 when the dowels 40 and pins 41 are engaged. Thus when in the shipping mode this locking system is not engaged; in contrast see FIG. 8 showing the locking system engaged. The double cleats and double locking pins are arranged on the inner and outer frame members so that when the inner frame is removed from the dowel and pin engagement shown in FIG. 7 and turned one hundred and eighty degrees, the cleats and locking pins will register with one another as shown in FIG. 8.

Figure 9:
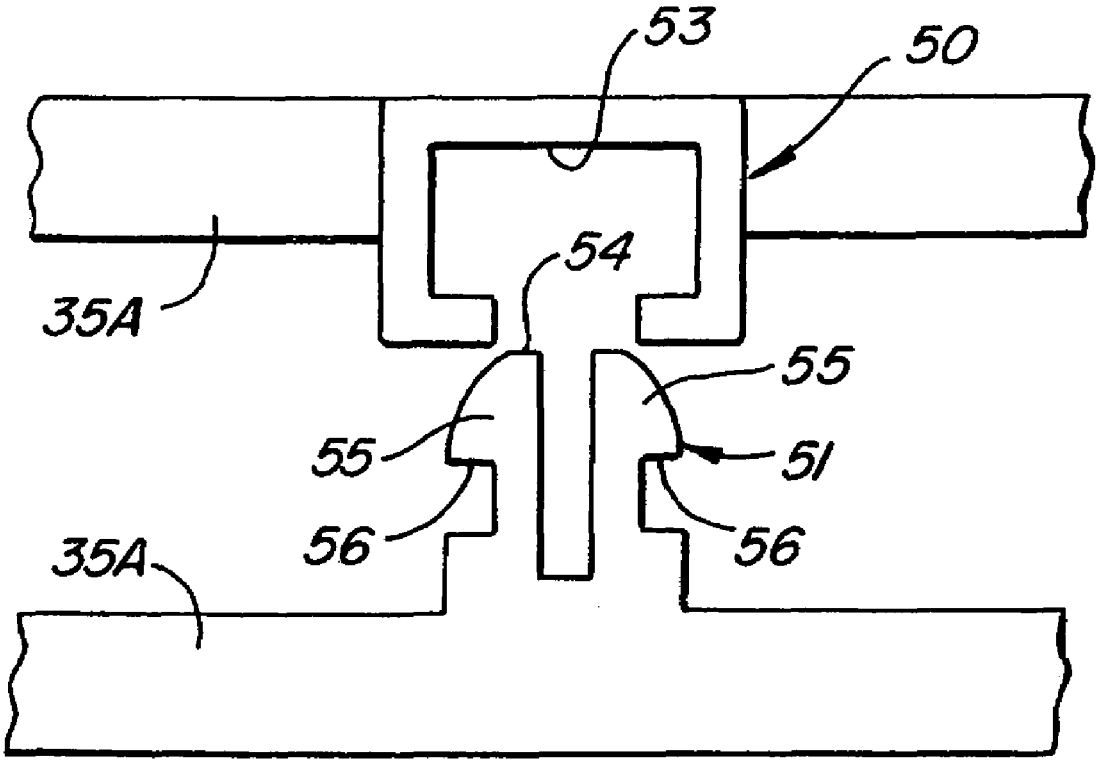
FIG. 9 is an elevation of an enlarged detail of one of the elements in locking system for the frame system.

Referring to FIG. 9 the details of the locking system for the frame system 30 is shown. As indicated there is a double cleat 50 and it includes a base member 53 against which the tops 54 of the split locking pins 51 abut when these pins enter the double cleat. As shown the heads 55 of the locking pins are tapered so that when the cleat is forced onto the pins they will be displaced toward one other so that the heads will pass through the opening in the double cleat and then spring open so that the ledge 56 at the base of each head will engage the base 57 of the several cleats locking the inner frame member 33 to the outer frame member 32 through a plurality of such double cleats and locking pins arranged in spaced relationship along frame members.

The travel of the locking pins 51 into the double cleat is limited when the heads 54 engage the base 53 of the double cleat 50 which prevents an installer from overly compressing the components in the frame system 30, such as disturbing the seals around the window light or compressing the ridge foam in the door in which the frame system is being installed.

The frame systems 30 is made for specified door thicknesses, and in the instant case for a door having a thickness of one and three quarter inches. Thus again referring to FIG. 5 it can be appreciated when the system is installed a caulking strip or sealing elastomer 60 is added to the groove 61 in inside surface of the extending flange 32A of the outer frame member 32 before this member, with the window light installed, is inserted in an aperture in the door 24. Since the window light is already sealed in the outer frame member, the caulking strip will seal out the elements impinging on the outer surface of the door around the periphery of the frame system 30. Before the inner frame member 33 is assembled a caulking strip or sealing elastomer 62 can be applied to the groove 63 in the inside face of its extending flange 33A if desired and also in its groove 64 of the surface engaging the window light. However since the inside of the door does not have to weather the elements these additional sealing elements are optional.

While an elongated frame configuration for the frame system has been described it should be appreciated that other configurations can employ the features the invention, such as a circular frame (not shown). In the latter described configuration the inner and outer frame members 33 and 32 need not be rotated one hundred and eighty degrees to bring the locking cleats 50 in to registry with the double locking pins 51 as will be appreciated from the forgoing description of the invention. Moreover the locking cleats and locking pins may alternate along the perimeter of each of the frame members, with the locking cleats being on the inner frame member and at other times being on the outer frame member.

Since the frame members 32 and 33 are plastic, formed by injection molding they do not have exceptional rigidity. In the instant invention ABS is used because it has a higher temperature resistance than polystyrene, and also a higher temperature resistance than polypropylene, which are the typical plastics used for prior art frames. Using ABS allows frames to be easily stained and painted in the field.

When using ABS to construct the frame members 32 and 33, the double locking cleats 50 or locking pins 51 should be located at a distance of no more than ten (10) inches apart on each of the frame members and more preferably about seven (7) inches apart. A suitable range is between five (5) and eight (8) inches. With such spacing the frame system 30 will be tightly retained against inside and outside faces the door on which it is installed without gaps or distortion in the frame members.

We claim:

1. A frame assembly for retaining a window in a door panel, comprising:

a first frame member having a first screwless interlock;

a second frame member having a second screwless interlock, the first and second interlocks being engageable by insertion of one into the other so as to couple said first frame member and said second frame member together in a first orientation on said door panel, at least one of the first interlock and the second interlock having a stop to prevent overinsertion of one of the first and second interlocks when the first and second interlocks are being engaged;

a first temporary support member disposed on the first frame member, offset from the first screwless interlock; and a second temporary support member disposed on the second frame member, offset from the second screwless interlock operable when joined to keep said frame members in registry in a second orientation without the first screwless interlock and the second screwless interlock being in registry where the second orientation is offset by 180 degrees from the first orientation.

2. The frame of claim 1, wherein the first interlock is male interlock, the second interlock is a female interlock, and the stop prevents overinsertion of the first interlock into the second interlock.

3. The frame of claim 2, wherein the stop is part of the first interlock.

4. The frame of claim 3, wherein the stop is part of the second interlock.

5. The frame of claim 1, wherein the first screwless interlock is integrally formed as part of the first frame member.

6. The frame of claim 5, wherein the stop is integrally formed as part of the first screwless interlock.

7. The frame of claim 1, wherein the second screwless interlock is integrally formed as part of the second frame member.

8. The frame of claim 7, wherein the stop is integrally formed as part of the second screwless interlock.

9. The frame assembly of claim 1, wherein the temporary support member includes a first temporary support integrally formed as part of the first frame member, and a second temporary support integrally formed as part of the second frame member.

10. The frame assembly of claim 9, wherein the first temporary support and the second temporary support are configured to engage each other in a friction fit to form the temporary support member.

11. A frame assembly for retaining a window in a door panel, comprising:

a first frame member having a first screwless interlock;

a second frame member having a second screwless interlock;

the first and second interlocks being engageable by insertion of one into the other so as to couple said first frame member and said second frame member together in a first orientation on said door panel, at least one of the first interlock and the second interlock having a stop to prevent overinsertion of one of the first and second interlocks when the first and second interlocks are being engaged, and where the first interlock includes a pair of pins, the pair of pins being engageable by insertion together in the second interlock, each pin having a respective extending ledge; and a first temporary support member disposed on the first frame member, offset from the first screwless interlock; and a second temporary support member disposed on the second frame member, offset from the second screwless interlock operable when joined to keep said frame members in registry in a second orientation without the first screwless interlock and the second screwless interlock being in registry where the second orientation is offset by 180 degrees from the first orientation.

12. The frame of claim 11, wherein the stop includes a pair of ledges, each of the pair of ledges extending from a respective one of the pair of pins.

13. The frame of claim 12, wherein the second interlock includes a cleat.

14. The frame of claim 13, wherein the second interlock includes a double cleat.

15. The frame of claim 14, wherein the double cleat has base ends towards the second frame member and outward ends away from the second frame member, and the double cleat includes a planar stop member extending between the base ends of the double cleat.

16. The frame of claim 15, wherein the planar stop member connects the bases of the double cleat.

17. The frame of claim 11, wherein the pair of respective ledges are located at points outward from the base of the pin, the ledges facing outwardly from the first frame member.

18. A frame assembly for retaining a window in a door panel, comprising:

a first frame member having the first screwless interlock;

a second frame member having a second screwless interlock, the first and second interlocks being engageable by insertion of one into the other so as to couple said first frame member and said second frame member together in a first orientation on said door panel, at least one of the first interlock and the second interlock having a stop means for preventing overinsertion of one of the first interlock and the second interlock into the other of the first interlock and the second interlock; and temporary support members disposed on the first frame member and second frame member operable when joined to keep said frame members in registry in a second orientation without the first screwless interlock and the second screwless interlock being in registry where the second orientation is offset by 180 degrees from the first orientation.

19. A frame assembly for retaining a window in a door panel, comprising:

a first frame member having the first screwless interlock;

a second frame member having a second screwless interlock, the first and second interlocks being engageable by insertion of one into the other so as to couple said first frame member and said second frame member together in a first orientation on said door panel, at least one of the first interlock and the second interlock having a stop means for preventing overinsertion of one of the first interlock and the second interlock into the other of the first interlock and the second interlock, wherein the first interlock is integrally formed as part of the first frame member and includes a pair of pins, each pin having a respective pair of horizontal ledges extending from the pin;

the second interlock is integrally formed as part of the second frame member and includes a double cleat and a planar surface extending between the bases of the double cleat, the pair of pins being engageable by insertion together in the double cleat; and temporary support members disposed on the first frame member and second frame member operable when joined to keep said frame members in registry in a second orientation without the first screwless interlock and the second screwless interlock being in registry.

20. A window assembly for installation in a door panel, comprising:

a first frame member having a first screwless interlock;

a second frame member having a second screwless interlock, the first and second interlock being engageable by insertion of one into the other so as to couple said first frame member and said second frame member together in a first orientation on side door panel, at least one of the first interlock and the second interlock having a stop to prevent overinsertion of one of the first and second interlocks when the first and the second interlocks are being engaged;

temporary support members disposed on the first frame member and second frame member operable when joined to keep said frame members in registry in a second orientation without the first screwless interlock and the second screwless interlock being in registry where the second orientation is offset by 180 degrees from the first orientation; and a window pane held in place in the door panel by at least one of the first frame member and the second frame member when the first frame member is locked to the second frame member.

21. A window assembly for installation in a door panel, comprising:

a first frame member having a first screwless interlock;

a second frame member having a second screwless interlock, the first and second interlock being engageable by insertion of one into the other so as to couple said first frame member and said second frame member together in a first orientation on side door panel, at least one of the first interlock and the second interlock having a stop to prevent overinsertion of one of the first and second interlocks when the first and the second interlocks are being engaged;

temporary support members disposed on the first frame member and second frame member operable when joined to keep said frame members in registry in a second orientation without the first screwless interlock and the second screwless interlock being in registry where the second orientation is offset by 180 degrees from the first orientation; and a window pane held in place in the door panel by at least one of the first frame member and the second frame member when the first frame member is locked to the second frame member, wherein the first interlock is integrally formed as part of the first frame member and includes a pair of pins, each pin having a respective pair of horizontal ledges extending from the pin;

the second interlock is integrally formed as part of the second frame member and includes a double cleat and a planar surface extending between the bases of the double cleat, the pair of pins engageable by insertion together in the double cleat.

22. A door assembly, comprising:

a panel with an aperture, the panel having a first side and a second side;

a first frame member having a first screwless interlock, the first frame member operably contacting the first side of the panel;

a second frame member operably contacting the second side of the panel, the second frame member having a screwless interlock, the first and second interlocks being engageable by insertion of one into the other so as to couple said first frame member and said second frame member together in a first orientation on said panel, at least one of the first interlock and the second interlock having a stop to prevent overinsertion of one of the first and second interlocks when the first and second interlocks are being engaged; and a window pane held in place in the aperture by at least one of the first frame member and the second frame member when the first frame member is locked to the second frame member, temporary support members disposed on the first frame member and second frame member operable when joined to keep said frame members in registry in a second orientation without the first screwless interlock and the second screwless interlock being in registry where the second orientation is offset by 180 degrees from the first orientation.

23. A door assembly, comprising:

a panel with an aperture, the panel having a first side and a second side;

a first frame member having a first screwless interlock, the first frame member operably contacting the first side of the panel;

a second frame member operably contacting the second side of the panel, the second frame member having a screwless interlock, the first and second interlocks being engageable by insertion of one into the other so as to couple said first frame member and said second frame member together in a first orientation on said panel, at least one of the first interlock and the second interlock having a stop to prevent overinsertion of one of the first and second interlocks when the first and second interlocks are being engaged;

temporary support members disposed on the first frame member and second frame member operable when joined to keep said frame members in registry in a second orientation without the first screwless interlock and the second screwless interlock being in registry where the second orientation is offset by 180 degrees from the first orientation and a window pane held in place in the aperture by at least one of the first frame member and the second frame member when the first frame member is locked to the second frame member, the first interlock is integrally formed as part of the first frame member and includes a pair of pins, each pin having a respective pair of horizontal ledges extending from the pin;

the second interlock is integrally formed as part of the second frame member and includes a double cleat having base ends toward the second frame member and a planar surface extending between the base ends of the double cleat.

24. A frame assembly for retaining a window in a door panel, comprising:

a first frame member having a first screwless interlock and a first temporary support member; and a second frame member having a second screwless interlock and a second temporary support member, the first temporary support member and the second temporary support member operable when joined to keep the frame members in registry in a second orientation without the first screwless interlock and the second screwless interlock being in registry, the first and second screwless interlocks being engageable by insertion of one into the other so as to couple said first frame member and said second frame member together in a first orientation, where the second orientation is offset by 180 degrees from the first orientation on said door panel, wherein the first frame member and the second frame member are identical.

25. The frame of claim 24, wherein at least one of the first screwless interlock and the second screwless interlock have a stop to prevent overinsertion of the first and second screwless interlocks when the first and second screwless interlocks are being engaged.

26. The frame of claim 25, wherein the stop is part of the first screwless interlock.

27. The frame of claim 25, wherein the stop is part of the second screwless interlock.

28. A frame assembly for retaining a window in a door panel, comprising:

a first frame member having a first screwless interlock having a stop;

a second frame member having a second screwless interlock having a tab with an inner chamber; and temporary support members disposed on the first frame member and second frame member operable when joined to keep said frame members in registry in a second orientation without the first screwless interlock and the second screwless interlock being in registry the first and second screwless interlocks being engageable by insertion of one into the other so as to couple said first frame member and said second frame member together in a first orientation, where the second orientation is offset by 180 degrees from the first orientation on said door panel, the first frame member and the second frame member being configured to be formed from the same mold cavity.

29. The frame of claim 28, wherein the stop prevents overinsertion of the first and second screwless interlocks when the first and second screwless interlocks are being engaged.

30. A frame assembly for retaining a window in a door panel, comprising:

a first frame member having a plurality of interspersed first type screwless interlocks and second type screwless interlocks;

a second frame member having a plurality of interspersed first type screwless interlocks and second type screwless interlocks, the first and second type screwless interlocks begin engageable by insertion of one into the other so as to couple said first frame member and said second frame member together in a first orientation on said door panel; and temporary support members disposed on the first frame member and second frame member operable when joined to keep said frame members in registry in a second orientation without the first screwless interlock and the second screwless interlock being in registry where the second orientation is offset by 180 degrees from the first orientation.

31. The frame of claim 30, wherein the first frame member and the second frame member are identical.

32. The frame member of claim 30, wherein the temporary support member is configured to keep the screwless interlocks out of engagement when the first and second frame members are parallel to each other in the first orientation, the temporary support member configured to allow the engagement of the first and second screwless interlocks when the first and second frame members are rotated into a second parallel; orientation in the same plane.

33. The frame of claim 30, wherein at least some of the screwless interlocks have a stop to prevent overinsertion when the interlocks are being engaged.

34. The frame of claim 30, wherein the first frame member and the second frame member are configured to be formed in the same mold cavity.

35. A frame assembly for retaining a window in a door panel, comprising:

a first frame member having a first screwless interlock;

a second frame member having a second screwless interlock, the first and second interlocks being engageable by insertion of one into the other so as to couple said first frame member and said second frame member together on said door panel, at least one of the first interlock and the second interlock having a stop to prevent overinsertion of one of the first and second interlocks when the first and second interlocks are being engaged; and temporary support members adapted to prevent the engagement of the first and second interlocks when the frame assembly is transported prior to installation, wherein the temporary support member includes a first temporary support integrally formed as part of the first frame member, and a second temporary support integrally formed as part of the second frame member.

36. The frame assembly of claim 35, wherein the first temporary support and the second temporary support are configured to engage each other in a friction fit to form the temporary support member.

* * * * *